US005454483A

United States Patent [19]

Ichikawa et al.

[11] Patent Number: 5,454,483

[45] Date of Patent: Oct. 3, 1995

[54] HOLDER FOR CONTAINING FLEXIBLE CONTAINER

[75] Inventors: Toru Ichikawa, Misato; Tomio Tahara, Tokyo, both of Japan

[73] Assignees: Hosokawa Yoko Co., Ltd.; Kamaya Kagaku Kogyo Co., Ltd., both of Japan

[21] Appl. No.: 289,642

[22] Filed: Aug. 12, 1994

[30] Foreign Application Priority Data

Aug. 23, 1993 [JP] Japan ..... 5-050106 U

[51] Int. Cl.[6] ..... B65D 6/00

[52] U.S. Cl. ..... 220/737; 220/410

[58] Field of Search ..... 220/737, 402, 220/403, 408, 410, 411

[56] References Cited

U.S. PATENT DOCUMENTS

| | | | |
|---|---|---|---|
| 3,233,817 | 2/1966 | Casady | 220/411 X |
| 3,819,036 | 6/1974 | Weldon . | |
| 4,560,085 | 12/1985 | Hofe et al. | 220/403 X |
| 4,865,208 | 9/1989 | Lax et al. | 220/737 X |
| 4,979,628 | 12/1990 | Robbins, III | 220/403 X |
| 5,071,002 | 12/1991 | Bradley | 220/737 X |
| 5,203,470 | 4/1993 | Brown . | |
| 5,299,700 | 4/1994 | Beniacar | 220/410 X |

FOREIGN PATENT DOCUMENTS 23561 4/1985 Japan .

OTHER PUBLICATIONS

Examiners's report to the Controller under Section 17 dated Sep. 27, 1994 (British Search Report).

*Primary Examiner*—Steven M. Pollard
*Attorney, Agent, or Firm*—Kane, Dalsimer, Sullivan, Kurucz, Levy, Eisele & Richard

[57] ABSTRACT

A holder for containing an inner flexible container comprising side walls 15, a bottom wall 16 and a top wall 17 is disclosed. The side walls 15 comprises; a first side wall having a handle 18 projecting in an outer direction, a second side wall having an open window 19 provided in a lower position thereof, a third side wall which is opposite to the second side wall and the upper portion of which has an opening 20 opened to the top end thereof. The top wall 17 has a guide notch which is opened in the opening 20 above the third side wall. The flexible inner container is inserted into the holder in an inclined state through the upper opening 20 of the third side and then is stood in an erect posture, interfitting the mouth of the flexible container into the guide notch of the top wall 17. The contents is dispensed through the mouth by using a torque lowering the side wall which is positioned opposite to the ear 18.

7 Claims, 2 Drawing Sheets

HOLDER FOR CONTAINING FLEXIBLE CONTAINER

BACKGROUND OF THE INVENTION

1. Industrial Field of the Invention

The present invention relates to a holder for containing and holding a bag-like flexible inner container therein which has a mouth projecting in the upward direction at a top portion thereof, in which the holder and the flexible inner container contained therein are treated as a unit and the contents of the flexible container can be dispensed by tilting the holder.

2. Related Art

Containers for liquid detergents, cooking oils, liquid condiments, and the like, for home use are generally used only once and are then thrown away. However, since such waste poses environmental problems, it is generally desired to decrease the quantity of such waste by using bag-like containers formed of a flexible film material.

Since such flexible containers are difficult to stand upright and are not stable, a container in which a flexible container is supported by a stiff outer housing (holder) in order to stand the flexible container erect and so that the contents can be dispensed through a dispenser, has been proposed (see Japanese Utility Model Application Kokoku (Post-Exam Publication) No. Hei 1-23561). In this container, a dispenser projecting outside the holder in the upward direction is attached to the flexible container, and the contents therein are dispensed by a finger pump. Generally, the dispenser and the holder are repeatedly used; the flexible inner container, however, is used only once and is then thrown away.

Most containers for filling with liquid detergents, cooking oils, liquid condiments, and the like, for home use have a large capacity, e.g., a capacity of 1 liter or more. Such a container may be formed by using a flexible film material in order to decrease the quantity of waste and by using no dispenser in order to reduce the cost thereof. In this case, the flexible container is included in a stiff holder and has a projecting outlet at the top portion thereof, and the contents in the flexible container can be dispensed by tilting the holder.

Such a container is convenient for home use. For example, use of such a container enables pouring a large quantity of cooking oil or the like into a pan. However, when a holder with a simple cylindrical or box shape is used, it is inconvenient and somewhat difficult to lift and tilt the holder containing a large and heavy flexible container. In such an event, there is a possibility that a hand of a person may make contact with the liquid contents which may have dripped on the outer surface of the holder, and there is also the possibility of the container being dropped.

Further, in the container having a double structure with a dispenser, the flexible inner container is generally inserted and held in the holder by screwing or sliding the flexible inner container into the holder, which may be difficult for some persons in an ordinary household.

SUMMARY OF THE INVENTION

It is therefore an object of the present invention to provide an improved holder for containing and holding an inner container therein which has a mouth projecting in the upward direction at a top portion thereof.

Another object of the present invention is to provide an improved holder in which the flexible container can be very easily inserted and held in the holder.

Further object of the present invention is to provide an improved holder in which the contents of the inner container can be easily dispensed by tilting the holder, without the possibility of a hand of a person holding the holder contacting the liquid contents, even if the inner container and consequently holder containing the inner container is large and heavy.

In order to achieve the above-described objects, the holder of the present invention comprises side walls on one of which a handle projecting in an outer direction, a lower open window in a lower part of one of the side walls, and an upper opening in an upper part of a wall which is opposite to the open window. A top wall has a guide notch which opens into the upper side wall opening and a bottom wall. The holder has a shape and a size in which the inner container can be compactly included therein and the inner container can be inserted into the holder through the upper side wall opening by interfitting the mouth of the inner container into the guide notch of the top wall of the holder.

The flexible inner container is inserted into the holder in an inclined state through the upper side wall opening and then is placed in an erect position, interfitting the mouth of the flexible container into the guide notch of the top wall. When the flexible inner container is inserted into the holder in an inclined state, a part of the base of the flexible inner container will project out of the holder through the open lower side wall window. Therefore, the flexible inner container can be easily inserted and held in the holder, even if only a small space or clearance is provided between the holder and the flexible inner container included therein. When the holder with the flexible inner container therein is lifted up by grasping the handle, a torque is generated by the weight of the contents of the flexible inner container, which lowers the side wall which is positioned opposite to the handle. Therefore, it is possible to dispense the desired amount of the contents from the side opposite to the handle by inclining the holder an angle. That is, the flexible inner container can be easily inserted into the holder and the contents can be dispensed without the hand of a person holding the holder contacting the contents, even if the inner container and holder is large and heavy.

Preferably, the side wall opposite to the handle has an inclined surface in an upper portion thereof.

In such a structure, when the contents of the inner container held by the holder is transferred into a pan or the like, it is possible to pour the contents into the pan or the like, without spilling the contents, by bringing the inclined top surface opposite to the handle near or into contact with the pan or the like and placing the mouth of the inner container into the inside the pan or the like.

DETAILED DESCRIPTION OF THE INVENTION

Figure 1:
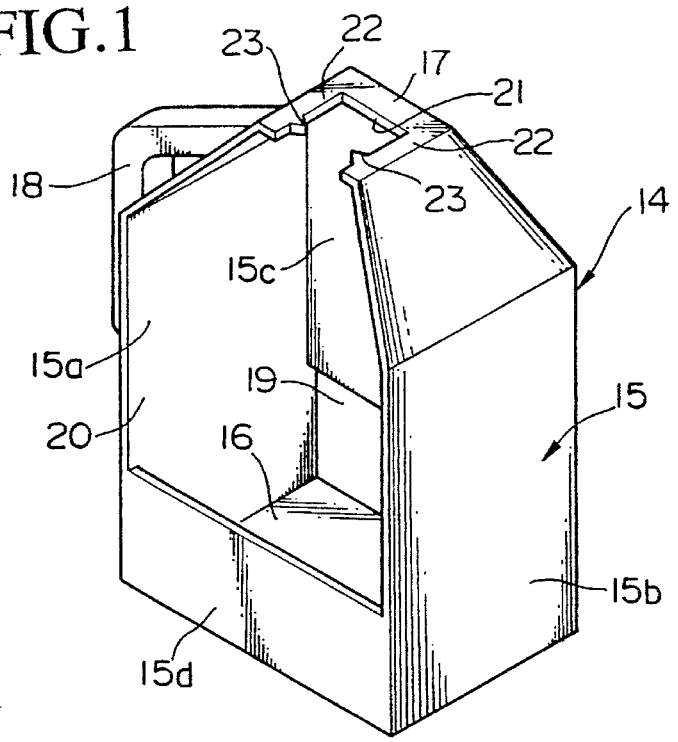
FIG. 1 is a perspective view showing an embodiment of the present invention.
Figure 2:
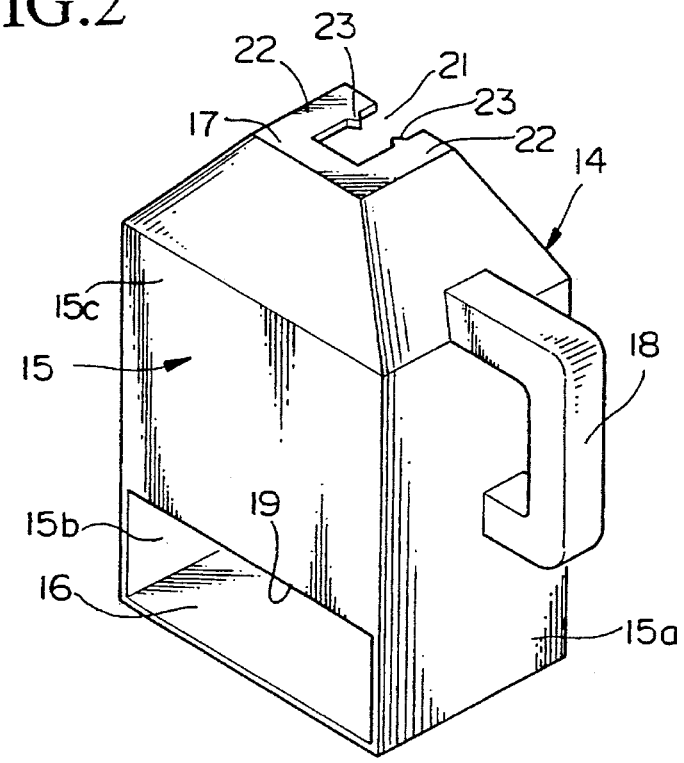
FIG. 2 is a perspective view from the opposite side of FIG. 1.

Hereinafter, an embodiment of the present invention will be explained with reference to the attached drawings.

A flexible inner container 1 is formed in a box-shape and is rectangular in plan view; and it is made of a flexible film material, e.g., a plastic film or a material made by laminating a metal foil, a paper, a cellophane, or a suitable combination thereof on a plastic film. The flexible inner container 1 has a seal portion 4 which is formed by putting the two flush together, and melting or otherwise adhering the front wall 2 and the rear wall 3 of the inner container 1 along the long dimension of the rectangle, on the top portion thereof. A cylindrical mouth 5 is attached at the central portion of the seal portion 4.

The cylindrical mouth 5 is made of a hard plastic material. The cylindrical mouth 5 has tongue portions 6 with pointed heads which project outwardly in opposite directions and are provided at opposite sides with respect to the center of the mouth 5 and on the base portion thereof sandwiched by the seal portion 4. In this regard, the front wall 2 and the rear wall 3 of the container 1 are connected to each other so as to form a hermetic seal with the tongue portions 6, and to the peripheral wall of the cylindrical mouth 5 by melting or adhering these parts. The cylindrical mouth 5 has two spaced flange portions 7 and 7 located a small distance above the tongue portions 6. The small space between the two flange portions 7, which sandwich the center of the cylindrical mouth 5, and are positioned in the sides of the front wall 2 and the rear wall 3 of the container 1, form an engagement groove 8. The upper part of cylindrical mouth 5 has a screw thread 9 for receiving an internally threaded cap 12. A pour opening 10 passing through the mouth 5 in a vertical direction.

The holder 14 according to the present invention which is suitable for containing and holding the flexible inner container 1 therein, comprising side walls 15, a bottom wall 16, and a small top wall 17. Holder 14 is generally made of a hard plastic or the like. The holder has a size and a shape so that the flexible inner container 1 can be compactly inserted into the holder.

The side walls 15 of the holder comprises four walls each of which has an inclined portion inclining toward the top wall 17. A first side wall **15*a* which is one of two less wide side walls 15*a* and 15*b* disposed opposite to each other has a handle 18 projecting in an outer direction and formed at approximately the center thereof by monobloc molding. A second side wall 15*c* which is one of two wider side walls 15*c* and 15*d* opposite to each other has an open window 19 provided in a lower part thereof. The open window 19 has approximately the same width as that of the long side of the bottom wall 16. A third side wall 15*d* which is opposite to the second side wall 15*c* has approximately the same height as that of the open window 19. An opening 20 extends from the top end of the third side wall 15*d* to the top wall 17**.

The top wall 17 has a guide notch 21 which opens into the opening 20 of the third side wall **15*d*. A pair of opposed stopper projections 23 are provided on the inner side surfaces of a pair of guide portions 22 of the top wall 17**.

Figure 3:
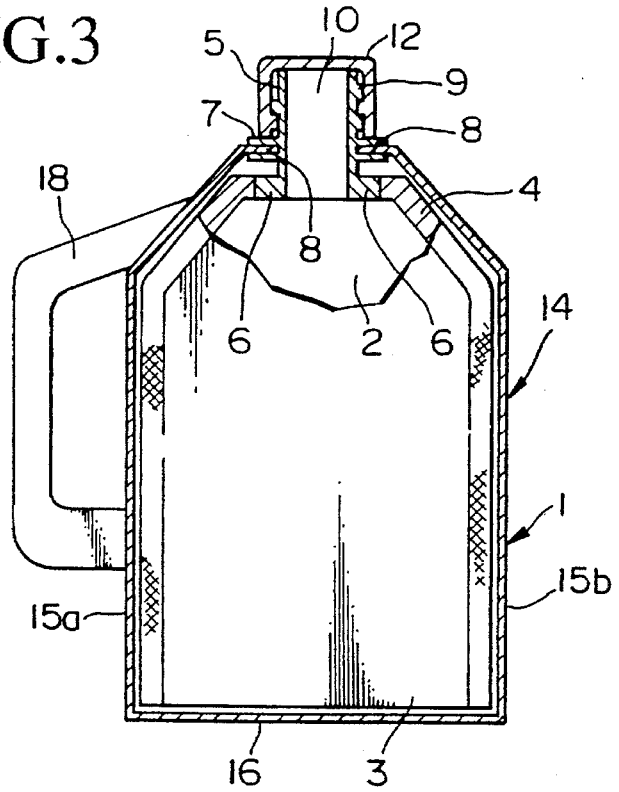
FIG. 3 is a sectional view showing the holder in which the flexible inner container is contained and held.
Figure 4A:
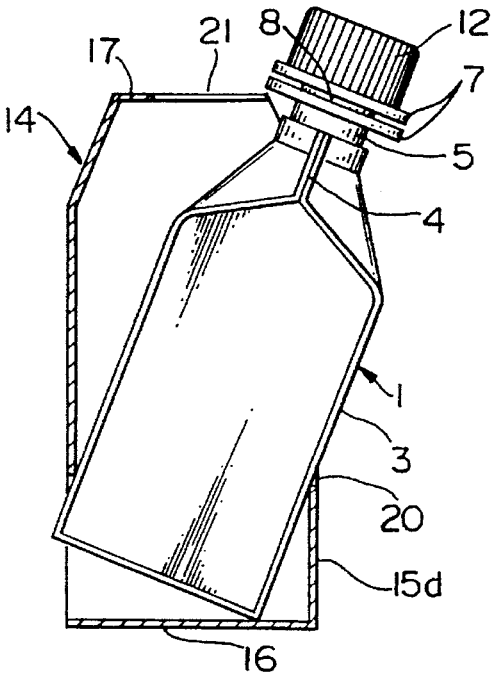
FIG. 4A is a sectional view illustrating the state of the holder and the flexible inner container when the flexible inner container is inserted into the holder in an inclined position.
Figure 4B:
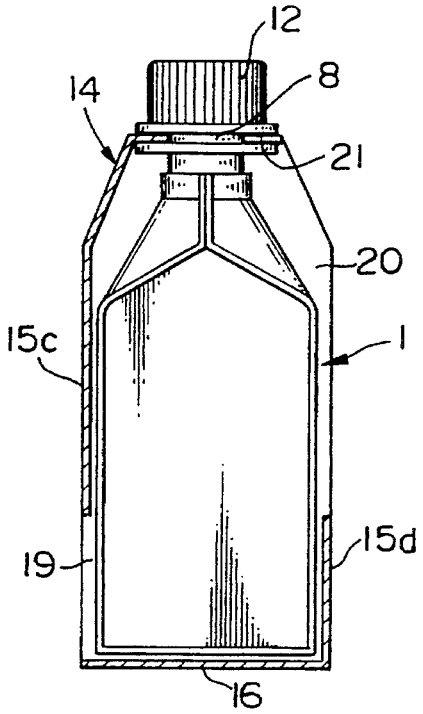
FIG. 4B is a sectional view illustrating the state of the holder and the flexible inner container after the inserted inner container was place in an erect position.

In the embodiment having such a construction, the flexible inner container 1 is inserted into the holder in an inclined state through the opening 20 above the third side wall **15*d*, avoiding the top wall 17 and the third side wall 15*d*, as shown in FIG. 4A. When the flexible inner container 1 is inserted into the holder in an inclined state, the lower edge 1*a* of the flexible inner container 1 projects out of the holder through the open window 19 of the second side wall 15*c*, and the lower edge 1*b* of the flexible inner container 1 is placed on the inner surface of the bottom wall 16. Then, with the holder 13 standing on in an erect position the inclined inner container 1 is rotated toward the guide notch 21 the container standing in an erect posture, for example, by pushing the cylindrical mouth 5 in the inner direction and sliding the lower edge 1*b* of the flexible inner container 1 on the bottom wall 16 in the direction of the third side wall 15*d*. Consequently, the cylindrical mouth 5 advances into the guide notch 21 and the inner side portions 22 and 22 of the top wall 17. The cylindrical mouth 5 is then forced to the inner end of the guide notch 21 after passing the stopper projections 23 and 23, and the flexible inner container 1 is now in an erect position. The flexible inner container 1 and the holder 14 are formed so that the inner container 1 can be completely inserted in the holder 14, as shown in FIGS. 3 and 4A. In this regard, only a small space is provided between the four side walls of the inner container 1 and the four side walls 15*a*, 15*b*, 15*c* and 15*d* of the holder 14, while the cylindrical mouth 5 projects in the upward direction from the top wall 17. In this position, the flexible inner container 1 is held by engagement of the pair of guide portions 22 and 22 of the top wall 17 in the engagement groove 8 between flanges 7, while the bottom surface of the inner container 1 is into contact with or spaced apart slightly from the bottom wall 16 of the holder 14**.

When the cap 12 is removed to open the pour opening 10 and the holder 14 having the flexible inner container 1 therein is lifted up by a hand holding handle 18, a torque is generated by the weight of the contents of the flexible inner container 1, which lowers the side wall **15*b* which is positioned at the side opposite to the handle 18. Therefore, the contents can be dispensed from the side opposite to the handle 18 through the hollow portion 10 by stopping the rotation of the holder at an appropriate angle by firmly holding the handle 18, or by further tilting the holder 14 at an angle larger than that obtained by the torque. Accordingly, even if the contents drip on the outer surface of the holder 14, the contents do not adhere to the hand of the person holding the holder 14**.

When the contents in the flexible inner container 1 have been consumed, the empty inner container 1 is pulled out to separate it from the holder 14 by moving the cylindrical mouth 5 to the side of the opening 20 along the guide notch 21. Thereafter, a new flexible inner container 1, filled with contents, is inserted into the holder 14 in a similar manner as described above.

In the illustrated embodiment, since the flexible inner container 1 is compactly inserted into the holder, leaving a small space between the flexible inner container 1 and the four side walls 15 of the holder, and the inner side portions 22 and 22 of the top wall 17 of the holder are interfitted into the engagement groove 8, movement of the inner container 1 in the forward and rearward directions, in the right and left directions, and in the upper and lower directions, are restricted by the holder 14 as viewed in FIG. 3. Therefore, when the holder 14 with the inner container 1 therein is lifted up in order to dispense the contents or to transfer the holder and the holder is inclined, the inner container 1 cannot shift by a significant amount in the holder and cannot escape from the holder. Therefore, it is possible to reliably handle the holder containing the inner container 1 as a unit.

Since each of the side walls 15, in particular, the side wall

15*b* opposite to the handle 18 has an inclined surface in an upper portion thereof, when the contents of the container 1 is transferred into a pan or the like, it is possible to pour the contents without spilling the contents, by bringing the inclined upper surface near or in contact with the pan or the like and placing the pour opening 10 inside the pan or the like.

The inclined upper walls of the side part 15 are not essential in order to achieve the object of the invention. It is possible to use a guide notch 21 having a construction which can only project the pour opening 10 therefrom, since movement in the vertical direction of the inner container 1 can be prevent by the bottom wall 16 and the top wall 17.

As explained above, the holder of the present invention comprises: side walls comprising a second side wall having an open window provided in a lower part thereof, a side wall which is opposite to the second side wall and the upper portion of which is opened to the top end thereof; and a top wall having a guide notch which is opened in the direction of the opened side of the third side wall; wherein the flexible container can be inserted into the holder through the opened side of the third side wall by interfitting the mouth of the flexible container into the guide notch of the top wall. Therefore, the flexible inner container is inserted into the holder in an inclined state through the upper opening of the third side wall and then can be placed in an erect posture, interfitting the mouth of the flexible container into the guide notch of the top wall. Therefore, the flexible inner container can be easily inserted and held in the holder, even if only a small space is provided between the holder and the flexible inner container included therein. Furthermore, it is possible to hold the inner container in a stable condition, since the holder has four side walls.

When the holder with the flexible inner container therein is lifted up by grasping the handle, a torque is generated by the weight of the contents of the flexible inner container, which lowers the side wall which is positioned opposite to the handle. Therefore, it is possible to dispense a desired amount of the contents from the side opposite to the handle through the pour opening, by inclining the holder at a necessary angle. That is, the flexible inner container can be easily inserted into the holder and the contents can be dispensed without the contents coming into contact with the hand of the person holding the holder, even if the inner container including the contents is large and heavy. Therefore, it is possible to handle the container without it slipping due to the contents making the outside of the holder slippery.

What is claimed is:

1. A holder for containing an inner container which has a mouth projecting in the upward direction at a top portion thereof, therein comprising:

side walls on which a handle projects in an outer direction, an open window in a lower part of one of the walls, another wall opposite the open window and having a top end, and an opening opened to the top end in an upper part of the another wall;

a top wall having a guide notch which is opened in the direction of the opening provided in an upper part of the another wall; and a bottom wall;

wherein the holder has a shape and a size in which the inner container can be compactly included therein and the inner container can be inserted into the holder through the opening by interfitting the mouth of the inner container into the guide notch of the top wall.

2. A holder as claimed in claim 1; wherein the holder is made of a hard plastic, and has a size and a shape defining a rectangle in plan view and into which the inner container can be compactly inserted.

3. A holder as claimed in claim 1; wherein the side walls comprising a first side wall having the handle projecting in an outer direction, a second side wall having the open window provided in a lower part thereof, and a third side wall which is opposite to the second side wall and has the opening opened to the top end.

4. A holder as claimed in claim 1, wherein the side wall opposite to the handle has an inclined surface in an upper portion thereof.

5. A holder as claimed in claim 1, wherein a pair of stopper projections opposed to each other are provided on a pair of inner side portions of the top wall which sandwich the guide notch.

6. A holder as claimed in claim 1; wherein the mouth of the flexible inner container has an engagement groove on the outer periphery thereof, and the holder has a construction so that a pair of inner side portions of the top wall which sandwich the guide notch can be interfitted into the engagement groove of the mouth, by rotating the inner container in the direction of the inner container in an erect posture which is inserted into the holder in an inclined state through the open window.

7. A holder as claimed in claim 1; wherein the holder has a construction so that the inner container inserted into the holder is held by the mouth thereof hung on a pair of inner side portions of the top wall of the holder.

* * * * *